US011000878B2

(12) United States Patent
Baylis

(10) Patent No.: US 11,000,878 B2
(45) **Date of Patent: *May 11, 2021**

(54) GLUE GUN

(71) Applicant: STONERIDGE KITCHEN & BATH LLC, Rockland, MA (US)

(72) Inventor: Steven P. Baylis, Rockland, MA (US)

(73) Assignee: STONERIDGE KITCHEN & BATH LLC, Rockland, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/504,933

(22) Filed: Jul. 8, 2019

(65) Prior Publication Data

US 2020/0139397 A1 May 7, 2020

Related U.S. Application Data

(63) Continuation of application No. 15/849,240, filed on Dec. 20, 2017, now Pat. No. 10,343,183.

(Continued)

(51) Int. Cl.

| | |
|---|---|
| ***B05C 17/005*** | (2006.01) |
| ***B05C 17/01*** | (2006.01) |
| ***B05B 15/62*** | (2018.01) |

(52) U.S. Cl.

CPC .. *B05C 17/00576* (2013.01); *B05C 17/00516* (2013.01); *B05C 17/00596* (2013.01);

(Continued)

(58) Field of Classification Search

CPC ..... B05C 17/00576; B05C 17/00596; B05C 17/0052

(Continued)

(56) References Cited

U.S. PATENT DOCUMENTS 2,103,111 A * 12/1937 Ekdahl ..... B65D 35/38 222/545
2,240,046 A * 4/1941 Marra ..... B05C 17/0113 222/391

(Continued)

FOREIGN PATENT DOCUMENTS

| | | |
|---|---|---|
| DE | 203 09 471 U1 | 2/2004 |
| JP | 2000-033305 A | 2/2000 |

(Continued)

OTHER PUBLICATIONS

International Search Report and Written Opinion dated Mar. 1, 2018 in connection with International Application No. PCT/US2017/067582.

(Continued)

*Primary Examiner* — Michael J. Melaragno
(74) *Attorney, Agent, or Firm* — Wolf, Greenfield & Sacks, P.C.

(57) ABSTRACT

Various aspects and embodiments are directed to a precision dispenser that is hand held and constructed and arranged to receive and release a variety of glue cartridges. In various embodiments, the adhesive cartridges include precision tips that provide, for example, flat even bead with little or no spill or drip. Other precision tips can be constructed and arranged for use with the precision glue gun. In some examples, the precision tips can be tailored to the specific adhesive contained in the cartridge.

19 Claims, 13 Drawing Sheets

Related U.S. Application Data

(60) Provisional application No. 62/437,578, filed on Dec. 21, 2016.

(52) U.S. Cl.
CPC ..... *B05C 17/0113* (2013.01); *B05B 15/62* (2018.02); *B05C 17/0052* (2013.01); *B05C 17/00553* (2013.01)

(58) Field of Classification Search
USPC ..... 222/392, 326, 490, 491, 494, 530, 538, 222/568, 575
See application file for complete search history.

(56) References Cited

U.S. PATENT DOCUMENTS 2,320,496 A * 6/1943 Wechsler ..... A21C 15/005 425/461
2,441,649 A * 5/1948 Sprague ..... B65D 35/38 222/92
2,550,132 A * 4/1951 Woods ..... B65D 47/2031 222/490
2,743,852 A * 5/1956 Alberdi, Jr. ..... B65D 47/2031 222/494
2,815,895 A * 12/1957 Reed ..... B65D 35/38 222/568
2,888,695 A * 6/1959 Anderson ..... A45D 40/26 401/266
2,928,533 A * 3/1960 Loucony ..... A23G 3/28 206/375
3,016,173 A * 1/1962 Stull ..... B65D 47/10 222/541.2
3,066,836 A * 12/1962 Trumbull ..... B05C 17/00576 222/327
3,191,809 A * 6/1965 Schultz ..... B65D 83/7532 222/182
3,195,784 A * 7/1965 Aaland ..... B65D 83/20 222/182
3,229,865 A * 1/1966 Heisler ..... B05C 17/0113 222/391
3,241,726 A * 3/1966 Chester ..... B65D 47/2031 222/211
3,254,869 A * 6/1966 Easey ..... A61M 39/28 251/4
3,273,754 A * 9/1966 Lindley ..... B65D 47/2031 222/92
3,273,760 A * 9/1966 Frankenberg ..... B65D 83/0005 222/386
3,285,256 A * 11/1966 Despard ..... A45D 29/16 132/74.5
3,884,396 A * 5/1975 Gordon ..... G01F 11/026 222/327
4,068,778 A * 1/1978 Wilson ..... B65D 25/40 220/600
4,109,836 A * 8/1978 Falarde ..... B65D 47/2031 137/849
4,133,457 A * 1/1979 Klassen ..... B65D 47/2031 137/849
4,269,330 A * 5/1981 Johnson ..... B65D 83/0005 222/386
4,284,213 A * 8/1981 Lee ..... B05C 17/00586 222/541.2
4,318,499 A * 3/1982 Hamilton ..... B05C 17/0113 222/327
4,356,935 A * 11/1982 Karnin ..... A47G 19/183 206/384
4,432,473 A * 2/1984 MacEwen ..... B65D 83/0072 222/327
4,440,324 A * 4/1984 Lebecque ..... B05C 17/0123 222/326
4,830,231 A * 5/1989 Smith ..... B65D 83/0005 222/327
4,946,081 A * 8/1990 Jacobson ..... B65D 35/38 222/568
4,957,225 A * 9/1990 Childers ..... B05C 17/00596 222/568
4,991,745 A * 2/1991 Brown ..... B65D 35/12 137/493
5,088,630 A * 2/1992 Arch ..... B05C 17/00516 222/326
5,139,178 A * 8/1992 Arch ..... B05C 17/00516 222/326
5,301,835 A * 4/1994 Fulks ..... B05C 17/00583 222/95
5,370,271 A * 12/1994 Segatz ..... B05C 17/00583 222/105
5,398,853 A * 3/1995 Latham ..... B65D 47/06 137/846
5,492,253 A * 2/1996 Proshan ..... B65D 47/06 222/212
5,743,443 A * 4/1998 Hins ..... B29C 45/1635 222/490
5,823,387 A * 10/1998 Manadanas ..... B65D 35/242 222/1
5,890,621 A * 4/1999 Bachman ..... A47G 19/2272 215/11.4
5,927,566 A * 7/1999 Mueller ..... B29C 45/1676 222/490
6,089,418 A * 7/2000 Gaiser ..... B65D 47/2031 222/490
6,112,926 A * 9/2000 Fishman ..... B65D 47/06 215/389
6,230,940 B1 * 5/2001 Manning ..... B65D 47/2031 220/89.1
6,290,108 B1 * 9/2001 Gross ..... B65D 47/2031 222/212
6,321,945 B1 * 11/2001 Girouard ..... B05C 17/0103 222/113
H2027 H * 6/2002 Brown ..... 137/455
6,446,844 B1 * 9/2002 Gross ..... B65D 47/2031 222/212
6,530,504 B2 * 3/2003 Socier ..... B65D 47/2031 222/212
6,616,019 B2 * 9/2003 D'Alessio ..... A61B 17/00491 222/547
6,655,554 B2 * 12/2003 Pantelleria ..... A47J 47/01 222/327
6,688,501 B2 * 2/2004 DeGroot ..... B65D 47/0804 222/556
6,892,904 B2 * 5/2005 Osborn ..... B05C 17/01 222/323
7,325,995 B2 * 2/2008 Keller ..... A61B 17/00491 222/566
7,445,135 B2 * 11/2008 Miyata ..... B65D 83/0005 222/326
7,543,724 B2 * 6/2009 Brunner ..... B65D 47/2031 222/494
7,784,652 B2 * 8/2010 Gaus ..... B65D 47/2031 222/494
7,874,466 B2 * 1/2011 McConville ..... B65D 47/2031 220/203.18
7,886,941 B2 * 2/2011 Pietrowski ..... B05B 11/007 222/494
7,959,038 B2 * 6/2011 de Oliveira ..... B65D 83/0005 222/326
7,971,755 B2 * 7/2011 Faurie ..... B65D 47/18 222/189.09
7,997,463 B2 * 8/2011 Quinn ..... B05C 17/00516 137/844
8,162,186 B2 * 4/2012 Maxwell ..... B65D 1/32 222/212
8,297,482 B2 * 10/2012 Hill ..... B05B 15/50 222/490
8,336,286 B2 * 12/2012 Veltrop ..... F16G 13/20 222/113
8,381,950 B2 * 2/2013 Veltrop ..... B05C 17/00576 222/391

(56) References Cited

U.S. PATENT DOCUMENTS 8,397,959 B2 * 3/2013 Helmenstein ..... B05C 17/00516 222/538
8,511,924 B2 * 8/2013 Bartolucci ..... B05C 17/00583 401/183
8,561,854 B2 * 10/2013 Tirone ..... A23G 3/2015 222/182
8,650,736 B2 * 2/2014 Robertson ..... B31B 50/74 29/428
8,770,449 B2 * 7/2014 Wellman ..... B65D 47/2031 222/213
8,985,402 B2 * 3/2015 Schneider ..... B65D 47/06 222/330
8,991,662 B2 * 3/2015 Milan ..... B05C 17/00506 222/327
9,174,236 B2 * 11/2015 Veltrop ..... B65D 83/0033
9,376,239 B2 * 6/2016 Edamatsu ..... B65D 47/103
9,586,734 B2 * 3/2017 Costello ..... B65D 83/0005
10,343,183 B2 * 7/2019 Baylis ..... B05C 17/00576
2003/0132253 A1 * 7/2003 Pantelleria ..... B65D 17/502 222/327
2003/0222160 A1 * 12/2003 Gordon ..... B05C 17/00516 239/602
2004/0112916 A1 * 6/2004 Hagihara ..... B65D 47/2031 222/92
2004/0251278 A1 * 12/2004 Arai ..... B65D 47/2031 222/212
2005/0006413 A1 * 1/2005 Miyata ..... B05C 17/00513 222/327
2005/0145653 A1 * 7/2005 Brandeis ..... B05C 17/0113 222/391
2005/0211735 A1 * 9/2005 Socier ..... B65D 47/2031 222/494
2007/0000943 A1 * 1/2007 Morgan ..... B65D 47/06 222/107
2008/0061089 A1 * 3/2008 Wellman ..... B65D 47/2037 222/494
2008/0237271 A1 * 10/2008 Olechowski ..... B65D 47/2031 222/494
2008/0264971 A1 * 10/2008 Harre ..... A61C 5/64 222/137
2009/0039112 A1 * 2/2009 Robertson ..... B23P 19/10 222/326
2009/0196677 A1 * 8/2009 Wright ..... A45D 40/00 401/264
2009/0224006 A1 * 9/2009 Post ..... F16H 19/04 222/333
2010/0155431 A1 * 6/2010 Bartolucci ..... B05C 17/015 401/171
2011/0168737 A1 * 7/2011 Veltrop ..... F16G 13/20 222/41
2011/0168741 A1 * 7/2011 Veltrop ..... B05C 17/0113 222/392
2011/0168742 A1 * 7/2011 Veltrop ..... B05C 17/0113 222/392
2012/0065608 A1 * 3/2012 Costello ..... B65D 47/2031 604/403
2012/0168469 A1 * 7/2012 Schwarze ..... B05C 17/00503 222/568
2013/0214013 A1 * 8/2013 Milan ..... B05C 17/00509 222/538
2013/0233886 A1 * 9/2013 Long ..... B65D 35/08 222/95
2014/0054327 A1 * 2/2014 Veltrop ..... F16H 19/006 222/392
2015/0014369 A1 * 1/2015 Hatton ..... F16K 15/147 222/490
2015/0016755 A1 * 1/2015 Sheikh ..... B29D 99/0096 383/80
2015/0053724 A1 * 2/2015 Veltrop ..... B65D 83/0033 222/392
2015/0053726 A1 * 2/2015 Heipp ..... B65D 47/2031 222/494
2018/0169694 A1 * 6/2018 Baylis ..... B05C 17/00576

FOREIGN PATENT DOCUMENTS

WO WO 2008/017330 A1 2/2008
WO WO 2016/018694 A2 2/2016

OTHER PUBLICATIONS

PCT/US2017/067582, dated Mar. 1, 2018, International Search Report and Written Opinion.

* cited by examiner

GLUE GUN

RELATED APPLICATIONS

This Application is a Continuation of U.S. application Ser. No. 15/849,240, filed Dec. 20, 2017, entitled "GLUE GUN", which is a Non-Provisional of Provisional (35 USC 119(e)) of U.S. Application Ser. No. 62/437,578, filed Dec. 21, 2016, entitled "GLUE GUN", the entire contents of these applications are incorporated herein by reference in their entirety.

BACKGROUND

Various conventional glue guns exist that provide for hand held dispensing of an adhesive. These commercially available glue guns incorporate a heating element and an adhesive that is not viscous at room temperature. The adhesive block is ratcheted into the heating element to dispense the adhesive. This approach results in messy and imprecise dispensers whose use is often accompanied by burns from the heating element.

SUMMARY

It is realized that a need exists for precision glue guns that are hand held and configured for clean (e.g., no drip) dispensing of adhesives (including, for example, glue, sealants, caulking, etc.) that are viscous at room temperature and harden to form a bond or seal. In various embodiments, precision glue guns can deliver wood glues or other adhesives without the mess associated with conventional approaches. And further, the precision glue guns can enable fine tune control and dispensing of any adhesive or sealant.

Various embodiments are directed to a molded housing that conforms to an operator's hand. The molded housing can include a cartridge receiver. In various examples, the molded housing receives an adhesive cartridge that contains the adhesive (e.g., wood glue, sealants, caulking, other glue, etc.) to be dispensed. Example cartridges are constructed and arranged of a cylindrical body housing a specific adhesive with a plunger base and a specialized top. The specialized top of the cartridge can be constructed and arranged to provide a flat even bead for the adhesive with little or dripping. In one example, the top includes a thin laser cut rubber or silicone sheet and a horizontal slit dispensing pattern. The rubber and/or silicone sheet provides self-sealing of the horizontal slit and further limits any dripping of the adhesive. In another embodiment, a drive shaft for the precision glue gun is housed entirely within the molded housing to facilitate use and deployment of the precision glue gun.

According to one aspect a glue gun is provided. The glue gun comprises a molded housing including a handle, a trigger, a drive piston having a flexible portion disposed internal to the molded housing or the handle (e.g., when in an at rest state), the drive piston operable upon actuation of the trigger, a cartridge housing constructed and arranged to accept and release adhesive cartridges, and an adhesive cartridge. In one embodiment, the adhesive cartridge is comprised of a body, a dispensing tip, and, a piston internal to the body constructed and arranged to force an ambient temperature adhesive through the dispensing tip upon pressure delivered via the drive piston. According to other embodiments, the glue gun can be used to dispense fluids beyond glue or traditional adhesives, and include for example, fluid dispensing of sealants, caulking, or other viscous fluids configured to dry after dispensing to create a bond, create a seal, or to be fixed in place.

According to one embodiment, the molded housing further comprises an operating channel disposed in the at least the handle. According to one embodiment, the operating channel includes: a first portion disposed in the handle, a curved portion constructed and arranged to: continue the operational space defined by the first portion; and direct the drive piston towards the cartridge housing (e.g., through an arcing portion). According to one embodiment, the glue gun further comprises a spring release constructed and arranged to engage the drive piston (e.g., at the flexible portion) and exert a return force on the drive piston responsive to advancing the drive piston through an operating channel. According to one embodiment, the glue gun further comprises the operating channel, wherein the operating channel includes a curved portion constructed and arranged to direct the drive piston from the handle into the cartridge housing. According to one embodiment, the glue gun further comprises a detent constructed and arranged to engage the drive piston and hold the drive piston in place. According to one embodiment, the glue gun further comprises a release constructed and arranged to disengage the detent from the drive piston. According to one embodiment, the piston forms a moveable seal with the body.

According to one aspect glue gun is provided. The glue gun comprises a molded housing constructed and arranged of: a handle; an operating channel within the molded housing and handle; a trigger constructed and arranged to advance a drive piston through the operating channel and into a cartridge housing; and the drive piston having a flexible portion disposed internal to the molded housing or the handle when in an at rest state, the drive piston operable upon actuation of the trigger to act on an adhesive cartridge within the cartridge housing to force an ambient temperature adhesive from a dispensing tip of the adhesive cartridge.

According to one aspect a glue gun is provided. The glue gun comprises a molded housing constructed and arranged of: a handle; an operating channel within the molded housing and handle; a trigger constructed and arranged to advance a drive piston through the operating channel and into a cartridge housing; and the drive piston having a flexible portion substantially disposed internal to the molded housing or the handle (e.g., when in an at rest state), the drive piston operable upon actuation of the trigger to advance a drive head to act on an adhesive cartridge within the cartridge housing and to force an ambient temperature adhesive from a dispensing tip of the adhesive cartridge.

According to one aspect a glue gun is provided. The glue gun comprises a molded housing constructed and arranged of: a handle; an operating channel within the molded housing and handle; a trigger constructed and arranged to advance a drive piston through the operating channel and into a cartridge housing; and the drive piston having a flexible portion substantially disposed internal the handle when in an at rest state, the drive piston operable upon actuation of the trigger to advance a drive head to act on an adhesive cartridge within the cartridge housing to force an ambient temperature adhesive from a dispensing tip of the adhesive cartridge.

According to one aspect a glue gun is provided. The glue gun comprises a molded housing constructed and arranged of: a handle; an operating channel within the molded housing and handle; a trigger constructed and arranged to advance a drive piston through the operating channel and into a cartridge housing; and the drive piston having a flexible portion substantially disposed within an operating channel, the operating channel having: a first portion disposed in the handle; and a curved portion disposed in the molded housing extending from the first portion, constructed and arranged to direct the drive piston towards the cartridge housing; wherein, the drive piston is constructed and arranged to travel through the operating channel upon actuation of the trigger to act on an adhesive (including for example, glues, sealants, or other viscous liquid/gel) cartridge within the cartridge housing.

According to one embodiment, the drive piston is constructed and arranged to force an ambient temperature adhesive from a dispensing tip of the adhesive cartridge. According to one embodiment, the molded housing further comprises and operating channel disposed in the at least the handle. According to one embodiment, the operating channel includes: a first portion disposed in the handle; a curved portion constructed and arranged to: continue the operational space defined by the first portion; and direct the drive piston towards the cartridge housing. According to one embodiment, the glue gun further comprises a spring release constructed and arranged to engage the drive piston (e.g., at the flexible portion) and exert a return force on the drive piston responsive to advancing the drive piston through an operating channel.

According to one embodiment, the glue gun further comprises the operating channel, wherein the operating channel includes a curved portion constructed and arranged to direct the drive piston from the handle into the cartridge housing. According to one embodiment, the glue gun further comprises a detent constructed and arranged to engage the drive piston and hold the drive piston in place. According to one embodiment, the glue gun further comprises a release constructed and arranged to disengage the detent from the drive piston.

According to one aspect an adhesive cartridge is provided. The adhesive cartridge comprises: a body portion; a sealed piston constructed and arranged to travel an interior of the body portion; a dispensing tip, the dispensing tip having: a flexible sheet at a dispensing end having a slit.

According to one embodiment, the flexible sheet is biases to maintain the slit in a closed position. According to one embodiment, the flexible sheet is biased to return the slit to a closed position. According to one embodiment, the adhesive cartridge further comprises an overmold cap at the dispensing end of the dispensing tip. According to one embodiment, the flexible sheet is disposed within the overmold cap. According to one embodiment, the dispensing tip includes a removeable first cap portion. According to one embodiment, the first cap portion includes a threaded portion that mates with a respective threaded portion on the body portion. According to one embodiment, the overmold portion is connected to the first cap portion.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments.

Any embodiment disclosed herein may be combined with any other embodiment in any manner consistent with at least one of the objectives, aims, and needs disclosed herein, and references to "an embodiment," "some embodiments," "an alternate embodiment," "various embodiments," "one embodiment" or the like are not necessarily mutually exclusive and are intended to indicate that a particular feature, structure, or characteristic described in connection with the embodiment may be included in at least one embodiment. The appearances of such terms herein are not necessarily all referring to the same embodiment. Various aspects, embodiments, and implementations discussed herein may include means for performing any of the recited features or functions.

BRIEF DESCRIPTION OF THE FIGURES

Various aspects of at least one example are discussed below with reference to the accompanying figures, which are not intended to be drawn to scale. The figures are included to provide an illustration and a further understanding of the various aspects and examples, and are incorporated in and constitute a part of this specification, but are not intended as a definition of the limits of a particular example. The drawings, together with the remainder of the specification, serve to explain principles and operations of the described and claimed aspects and examples. In the figures, each identical or nearly identical component that is illustrated in various figures is represented by a like numeral. For purposes of clarity, not every component may be labeled in every figure. In the figures:

DETAILED DESCRIPTION

Figure 1:
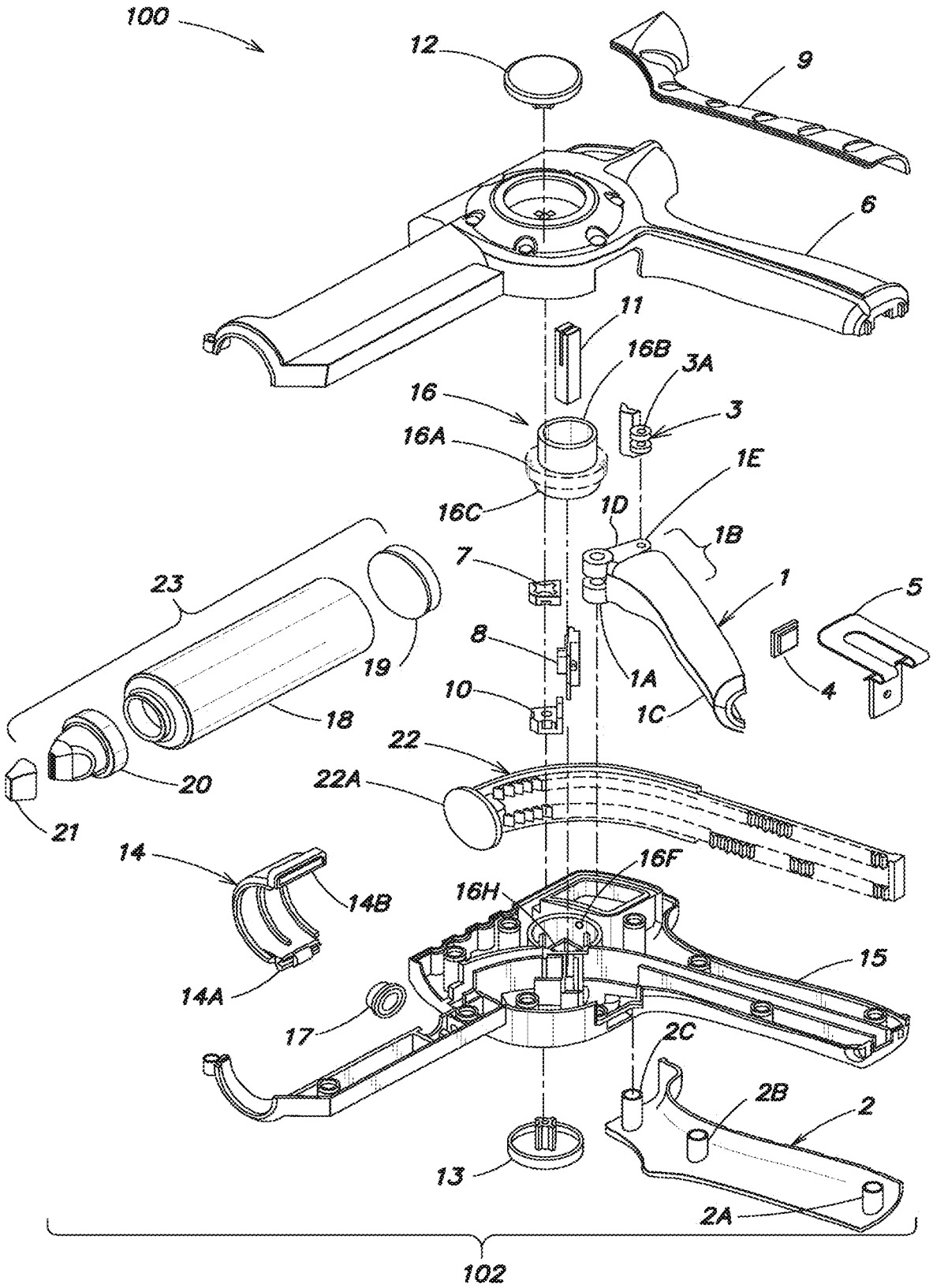
FIG. 1 shows an example glue gun in exploded view, according to various aspects and embodiments.

Various aspects and embodiments are directed to a precision dispenser that is hand held and constructed and arranged to receive and release a variety of glue cartridges. In various embodiments, the adhesive cartridges include precision tips that provide, for example, flat even bead with little or no spill or drip. Other precision tips can be constructed and arranged for use with the precision glue gun. In some examples, the precision tips can be tailored to the specific adhesive contained in the cartridge.

Generally stated, the overall function of the precision glue is similar to epoxy glue guns in that a plunger pushes against a sealed piston in a cartridge housing an adhesive. Actuation of the plunger pushes the sealed piston forward and extrudes the adhesive through a delivery tip. However, the precision glue gun greatly improves functionality over conventional approaches. For example, the precision glue gun facilitates work site use through its specialized and integrated construction. Further, the improvements in the cartridge construction also provide advantage over known approaches (e.g., little or no spill, actual re-usability, re-sealable adhesive cartridge, etc.). In one example, a flexible plunger is disposed entirely in the molded housing, and in further example, is releasable via a single hand operation with a push of a side button.

Examples of the system and operations discussed herein are not limited in application to the details of construction and the arrangement of components set forth in the following description or illustrated in the accompanying drawings. The methods and systems are capable of implementation in other embodiments and of being practiced or of being carried out in various ways. Examples of specific implementations are provided herein for illustrative purposes only and are not intended to be limiting. In particular, acts, components, elements and features discussed in connection with any one or more examples are not intended to be excluded from a similar role in any other examples.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, any combination of, and all of the described terms.

FIG. 1 illustrates an exploded view 100 of one embodiment of a precision glue gun 102. In the illustrated embodiment, the precision glue gun 102 is constructed and arranged having a trigger (1) with a first pivot connection (1A). The first pivot connection (1A) moveably secures the trigger (1) to a left housing (6) and right housing element (15). The first pivot connection (1A) can include an open cylindrical portion (e.g., (1A) which mates with a rod or pivot extending outward from the left and/or right housing (e.g., 6 and 15)). In some examples, the first pivot connection (1A) can be constructed and arranged of multiple open cylindrical portions, where respective portions mate with respective left (e.g., (6)) and right housing (e.g. (15)) elements. In other examples, the first pivot connection can have a contiguous outer circumference and an open inner portion to receive or mate with a rod portion extending from housing elements.

According to one embodiment, an upper portion of the trigger (1B) can also include a lever arm (1D), which in some examples can extend from the first pivot connection or from a body (1C) of the trigger (1). The lever arm is constructed with a mating opening (1E), to connect the trigger to a trigger push (3) at a respective mating opening (3A) on the trigger push. The trigger push (3) can have paired mating openings that surround the mating opening (1E). A pin (not shown) can be used to couple the trigger (1) and trigger push.

Further elements of the actuation mechanisms of the precision glue gun include a return spring housing (16), a release left (7), a release right (10), and a bracketing detent (8). The detent (8) releasably engages a piston (e.g., bent/flexible pushrod (22)) and piston engages the return spring housing (16), for example, at an internal section of teeth and/or cogs (16A) of the return spring housing. The return spring housing (16) is attached to the right and left housing (6, 15) through a spring mount (11) and respective molded sections in the right and left housing (e.g., (16H)—opposite side not shown). In one embodiment, the spring housing includes outer cylindrical portions (e.g., (16B) and (16C)) that engage with the glue gun left and right housing at respective cylindrical cavities (e.g., at 16F) thereby permitting rotation of the spring housing when not engaged by other components. The return spring housing (16) is biased to remain in an initial position when the piston is an un-deployed state via an internal spring or springs (not shown). When rotated, for example, by operation of the bent pushrod (22), the spring bias is prevented from counter rotation by engagement of the detent (8) on the piston (e.g., (22)). When the detent (8) is disengaged, the return spring (16) can act on the piston to pull back the piston (e.g., bent pushrod (22) and drive head (22A)) into the glue gun releasing pressure on the piston (e.g., (19)) of the adhesive cartridge (18). The pushrod 22 can include a plurality of teeth that engage upon actuation of the trigger mechanism to advance the pushrod towards an adhesive cartridge. In some examples, the pushrod can include multiple rows of teeth on a face of the pushrod and each row (or individual rows) can be used in actuation of the trigger or in maintaining the position of the pushrod.

Figure 3:
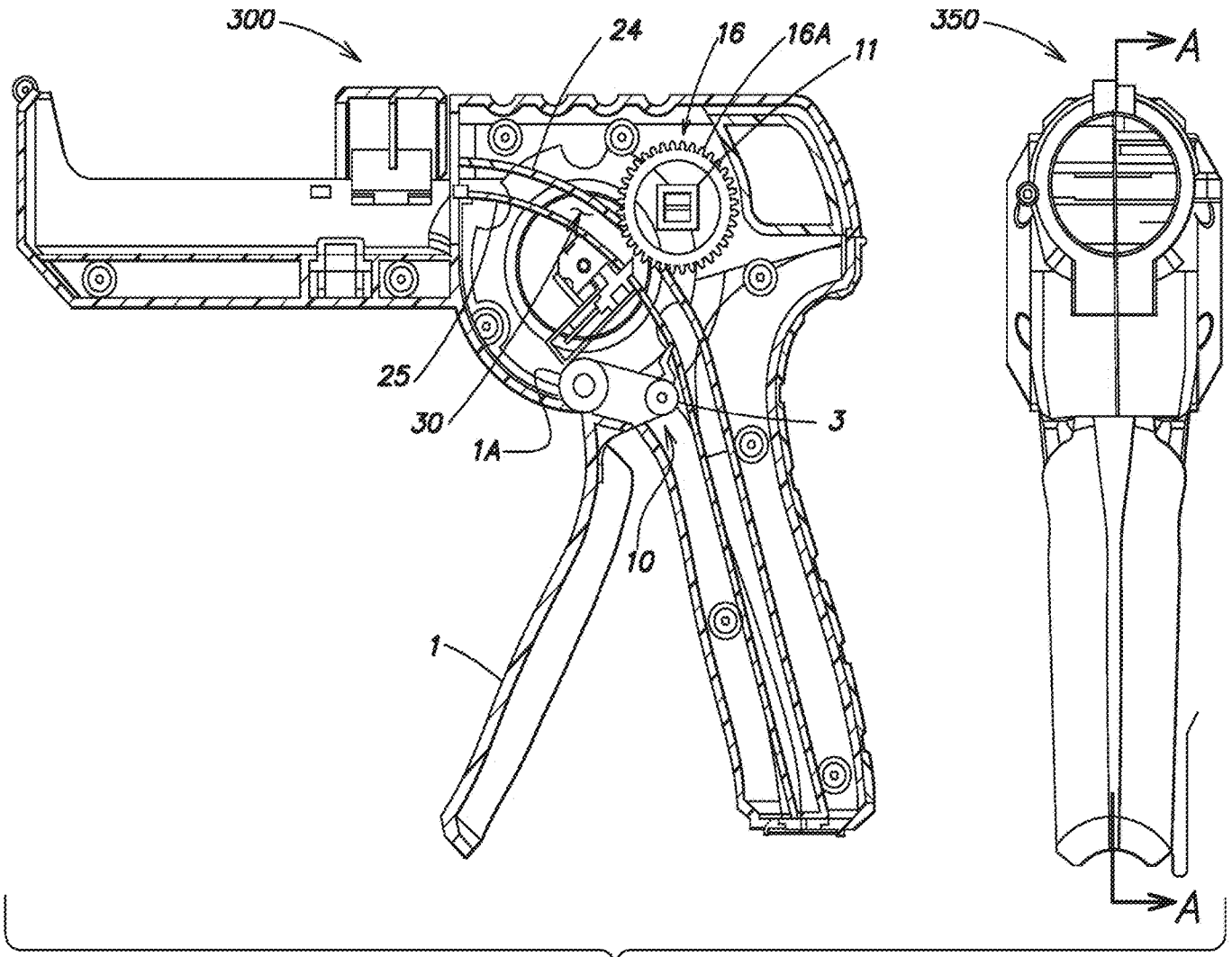
FIG. 3 shows is an internal view of an example glue gun, according to one embodiment.

FIG. 3 illustrates an internal view 300 of an embodiment of the glue gun showing section A-A of 350. Like numerals indicate similar components as the embodiment shown in FIG. 1. As shown in view 300, a piston or for example a bent pushrod (22) is guided in a curved operating channel (30). The operating channel is formed by an upper (24) and lower (25) boundary that extend within the molded housing of the glue gun. As shown in FIG. 3, detent (8) can releasably engage the piston in the operating channel 30 to prevent the return spring from pulling back the piston upon release of the trigger (1). Further, trigger push (3) engages the piston upon actuation of the trigger (1) and engagement of the detent (8) prevents the piston from moving back into the glue gun as the piston is advanced into a cartridge.

Returning to FIG. 1, depressing button (12) or (13) disengages detent (8) based on engagement between buttons (12) & (13) and release left (7) and release right (10). With detent (8) disengaged, the return spring (16) transitions the piston (e.g., bent push rod (22)) back into the glue gun handle releasing any pressure on the cartridge and/or piston (19).

As discussed, actuation of a plunger (e.g., 22) pushes a sealed piston (19) of the adhesive cartridge (23) forward into the cartridge body (18) and extrudes the adhesive through a delivery tip at the cap (20) and cap overmold (21). Various embodiments incorporate a flexible plunger that is configured to retract back into the handle portion of the gun with the push of a side button (e.g., (12) or (13)). When an operator squeezes the trigger (1), the attached trigger-push (3) pushes the plunger forward and into the cartridge (23). The detent (8) prevents the return spring housing (16) from retracting the plunger back into the handle. In one example, the return spring housing contains a constant force spring which retracts the plunger. When the operator presses either button ((12), (7) or (13), (10)) the detent (8) pulls away from the plunger and allows the spring force to pull the plunger back into the handle via rotation of the return spring housing (16).

According to some embodiments, the glue gun can include overmold portions to facilitate operator grip on the handle of the glue gun. For example, the gun can include a left and right overmold portion (e.g., (2) and (9)). The overmold portions can include grip ridges to increase gripping capability on the gun handle. Each overmold portion can be constructed with a plurality of attachment elements (e.g., (2A), (2B), (2C)) that extend from the overmold sections and mate with recessed portions on respective housing elements (e.g., (6) and (15)). The precision glue gun (102) can engage with a number of different cartridges each containing different adhesives. The glue gun can include a flip cap (14), constructed to secure the cartridge in place when the flip cap is locked or engaged. The flip cap is attached to the gun housing (e.g., (6) or (15)) at a pivot (14A), and is secured to the housing at (14B). The flip cap can be secured via a pressure fit engagement, key and lock, clip, latch, etc. In some embodiments, the gun can include a cartridge lift (17) component constructed to hold the cartridge in position within the housing. In one example, the cartridge lift can be fabricated of a resilient but flexible rubber material (or silicone) to facilitate engagement with the cartridge. In some implementations, the flip cap can engage the cartridge above and the lift engage the cartridge from below to secure the cartridge in place.

In further embodiments, the precision glue gun can include optional components to facilitate use by an operator. The optional components can include a clip retainer (4), and metal clip (5), constructed to, for example, attach the gun to an operator's belt.

Example Cartridge/Tip Embodiments

Figure 2:
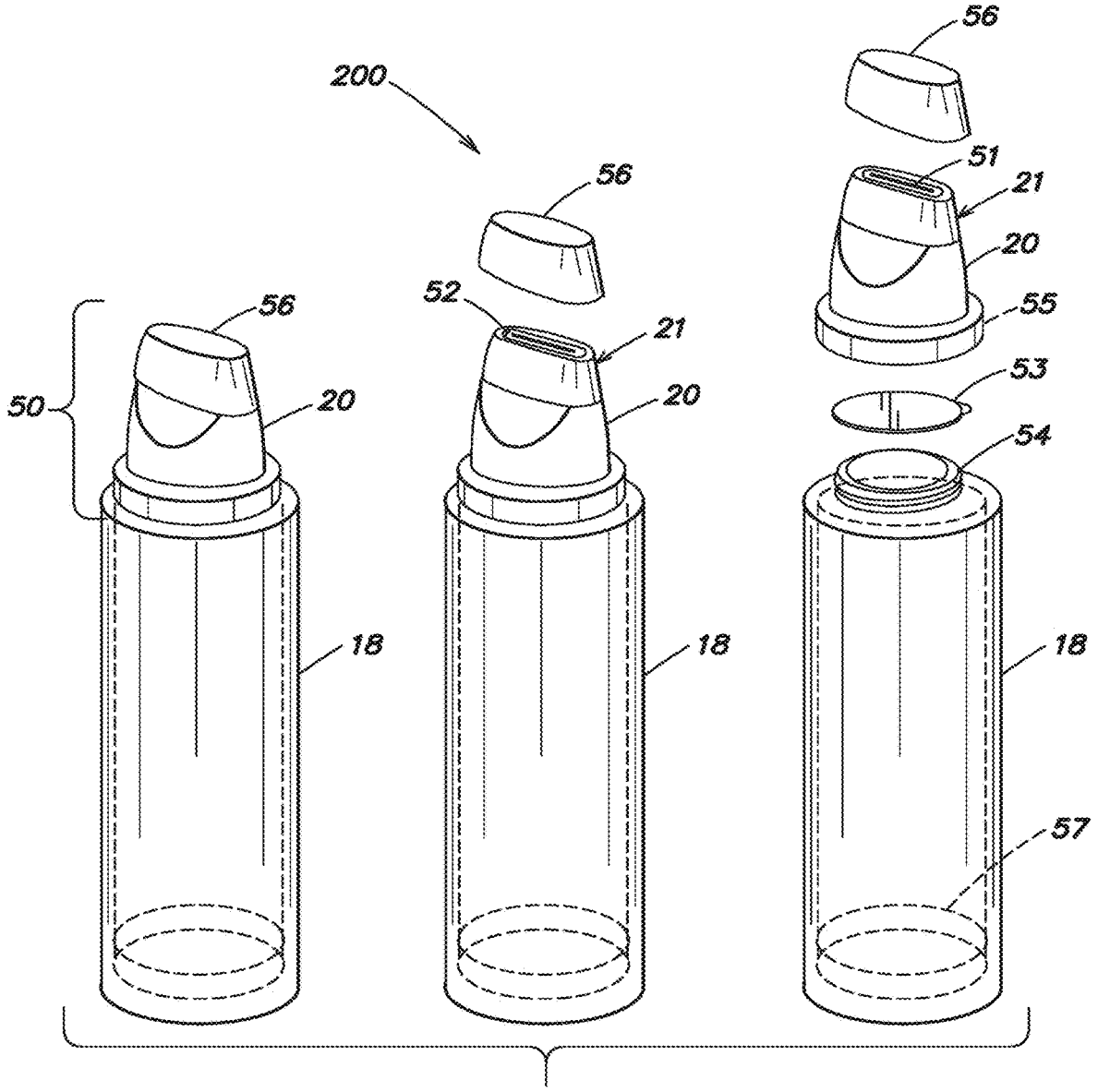
FIG. 2 shows an example adhesive cartridge, according to various aspects and embodiments.

According to some embodiments, the cartridge is constructed with a removable tip. For example, in one embodiment the removable tip can be threaded (e.g., at (55)) and screwed onto the cartridge body (e.g., at threaded portion (54) of the cartridge body (18)). FIG. 2 shows an example embodiment of an adhesive cartridge 200. In this embodiment, the cartridge tip (50) includes a cap (20) and a cap overmold (21). The overmold (21) pressure fits over the cap (20) and is constructed with a slit (51) cut into the top to allow adhesive to be extruded via pressure being applied to sealed piston (57). The slit (51) is cut into a sheet (52) at the top of the cap overmold (21). The sheet (52) is constructed of a flexible material with some rigidity, and further constructed to be biased to maintain the slit in a closed position. The bias in the sheet material is configured to naturally return the sheet to a sealed state (e.g., once pressure is released, for example by releasing pressure exerted on the sealed piston (57) by the plunger (e.g., (22))).

For distribution, the cartridge can include a seal (e.g., foil seal (53)), the seal prevents air exposure to the adhesive contained in the cartridge body. The slip over cap (56) can serve the same purpose once the foil is removed and/or the cartridge is used. Various embodiments are specially configured for ease of operation by a user, and for example, can be used based on single hand operation. For example, the spring loaded retraction of the plunger can be executed with a single button press, that allows for easy operation with one hand. The one hand operation is a feature not found on other conventional glue and/or epoxy guns. In another embodiment, the flexible plunger allows the product design to be more compact and less obstructive based on the moving parts being integral to the gun and/or handle. For example, other rigid plunger designs extend out the back of the gun and double the size of the overall unit.

FIGS. 4-8E includes additional implementation illustrations of some precision glue guns and implementation associated with the adhesive cartridge, and more specifically with the cap and adhesive delivery elements. Various embodiments are configured to employ the different implementation examples, and further, various cartridges can be implemented with the different delivery elements as shown in FIGS. 4-8E.

Figure 4:
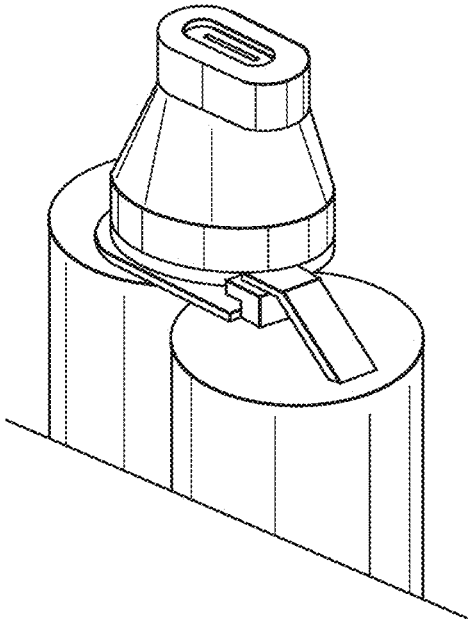
FIG. 4 shows an example embodiment of an adhesive cartridge tip, according to various aspects.
Figure 5A:
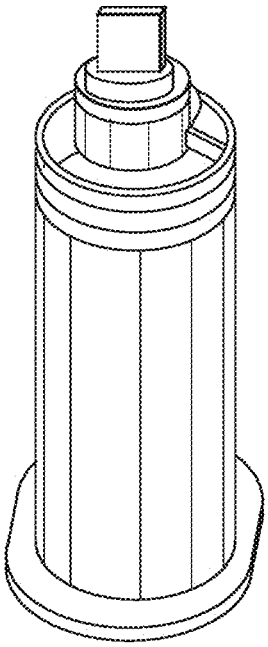
FIGS. 5A-5H show example embodiments of adhesive cartridge tips, according to various aspects.
Figure 5B:
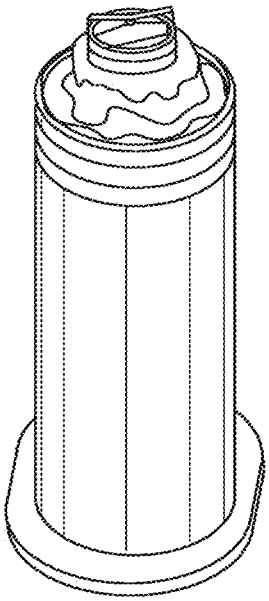
Figure 5C:
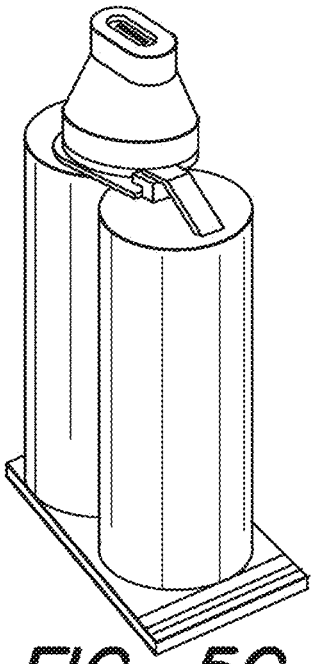
Figure 5D:
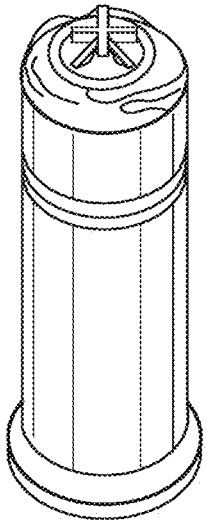
Figure 5E:
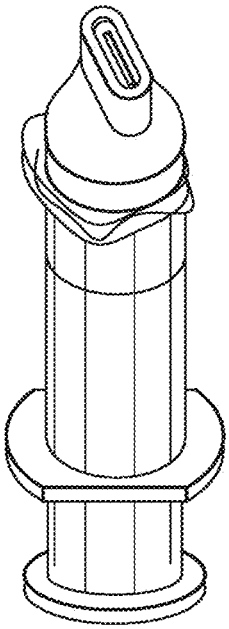
Figure 5F:
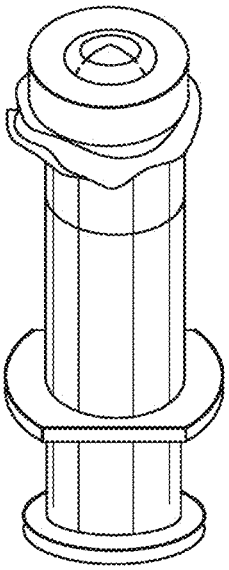
Figure 5G:
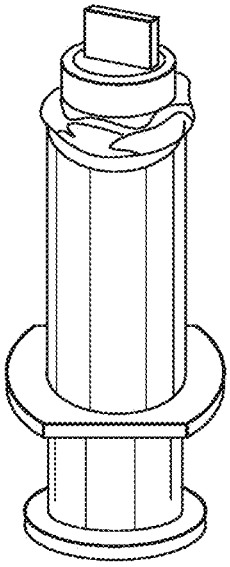
Figure 5H:
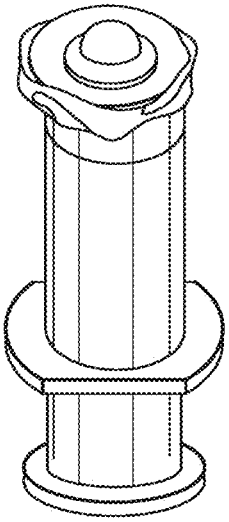
Figure 6A:
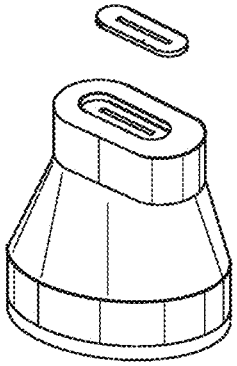
FIGS. 6A-6D illustrate an example tip and operation, according to various aspects.
Figure 6B:
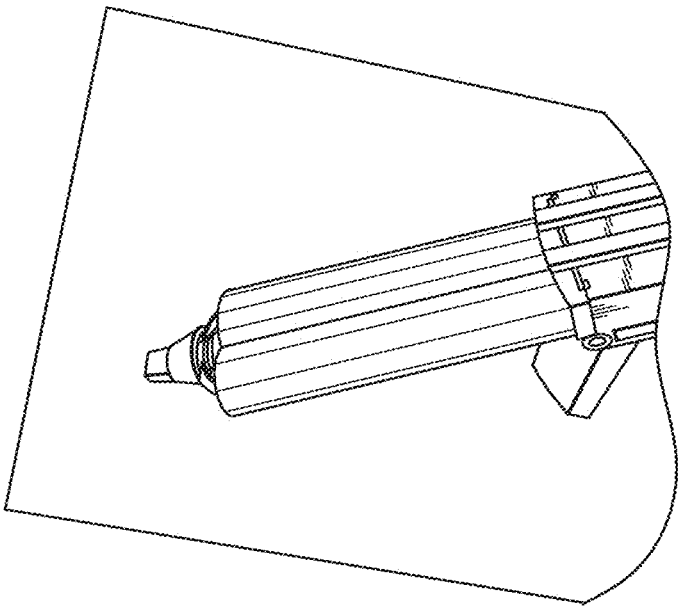
Figure 6C:
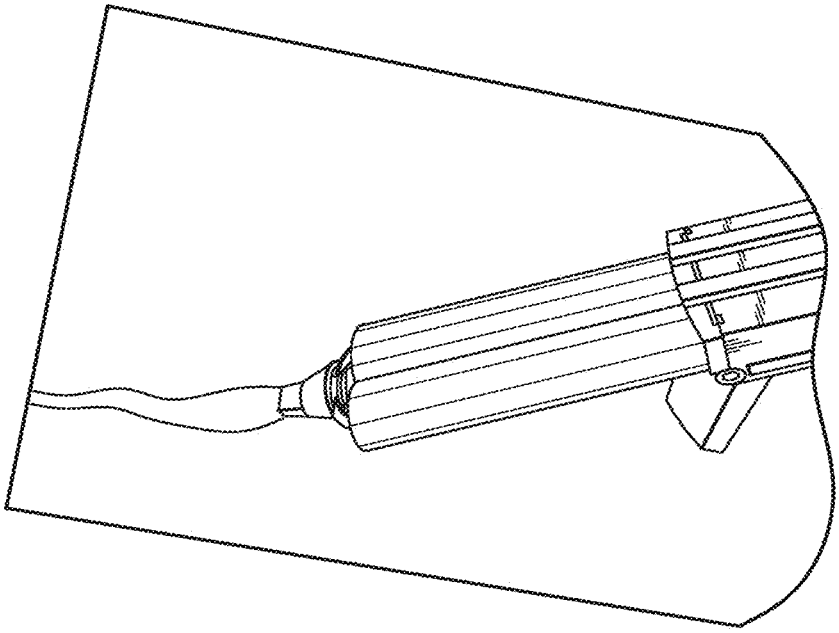
Figure 6D:
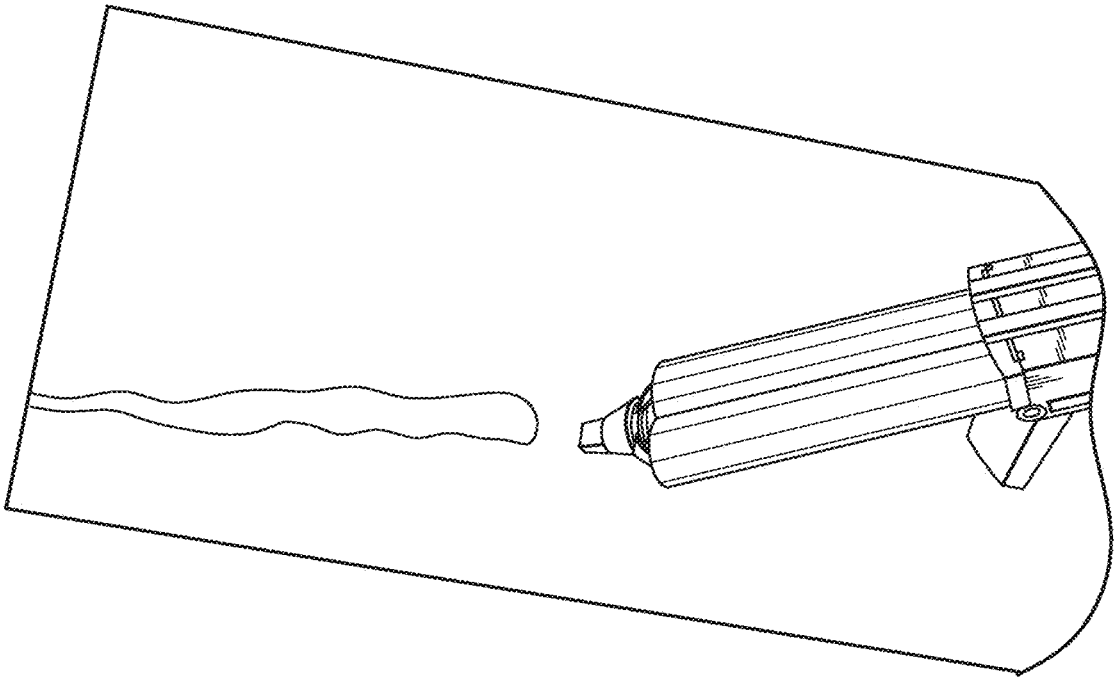
Figure 7A:
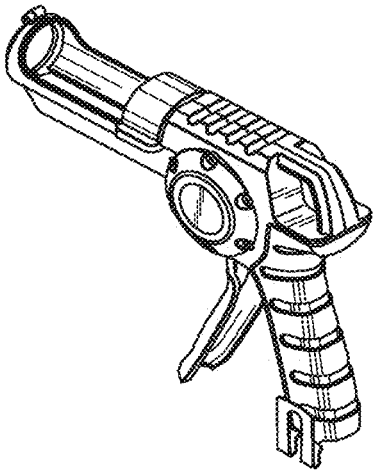
FIGS. 7A-7F illustrate views of one embodiment of a glue gun, according to various aspects.
Figure 7B:
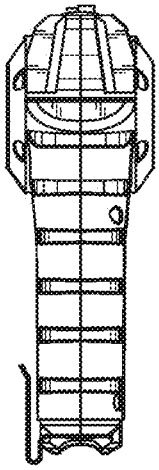
Figure 7C:
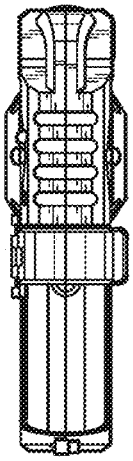
Figure 7D:
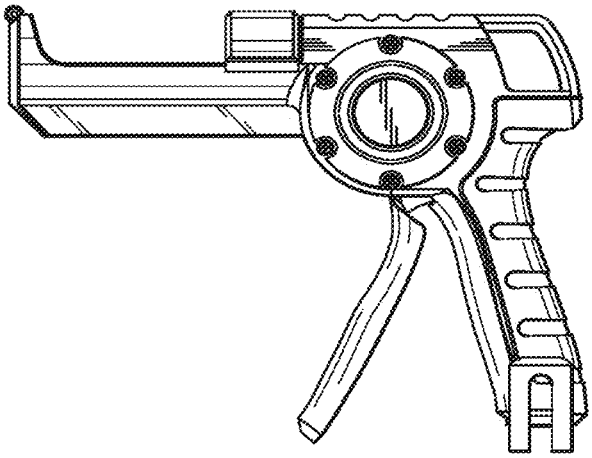
Figure 7E:
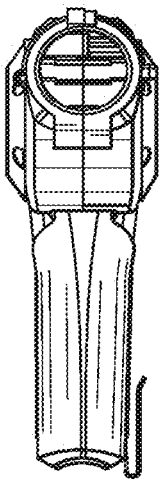
Figure 7F:
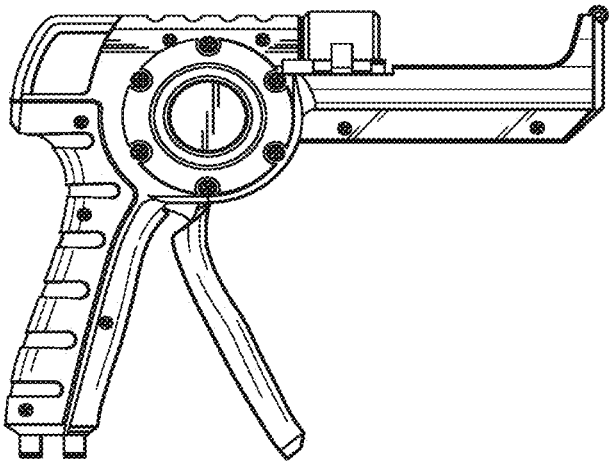
Figure 8A:
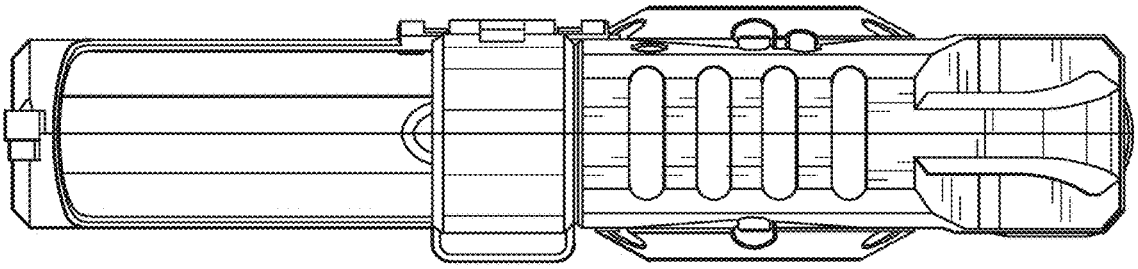
FIGS. 8A-8E illustrate views of one embodiment of a glue gun, according to various aspects.
Figure 8B:
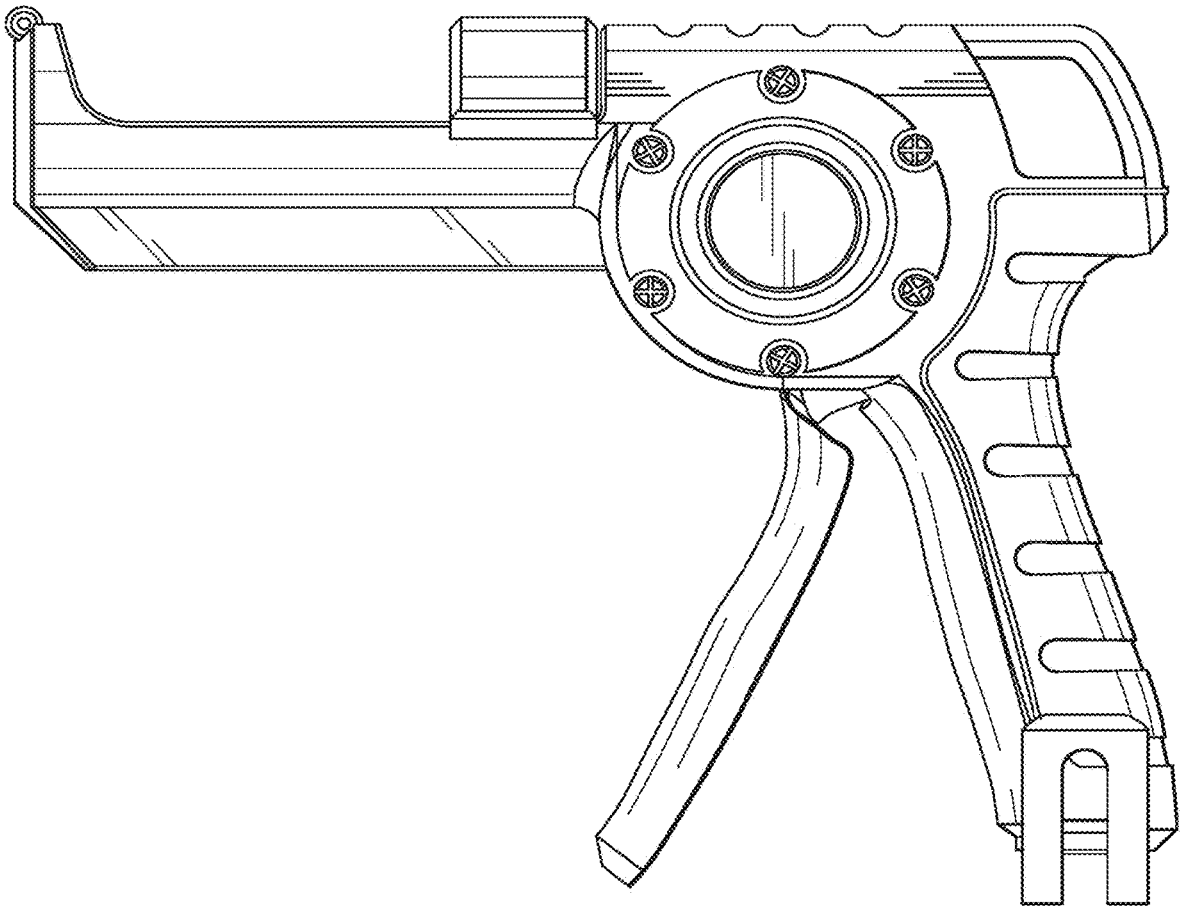
Figure 8C:
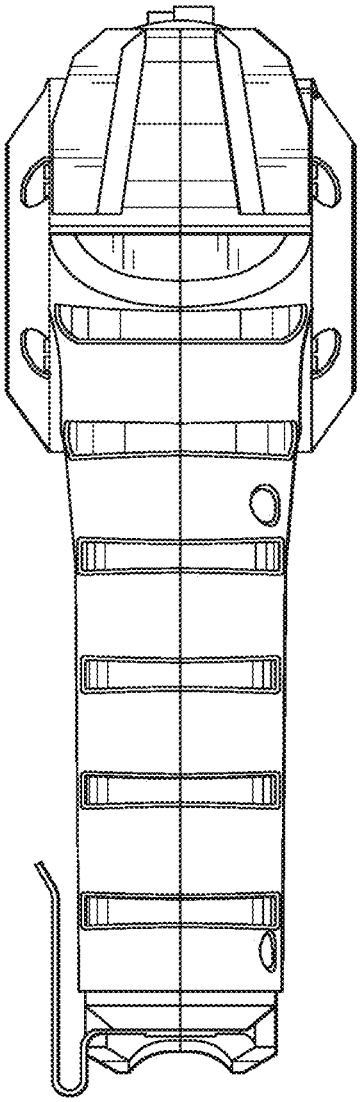
Figure 8D:
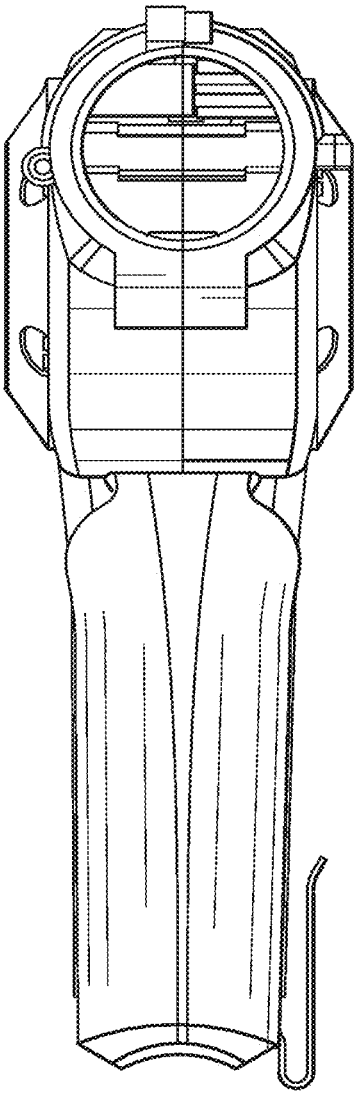
Figure 8E:
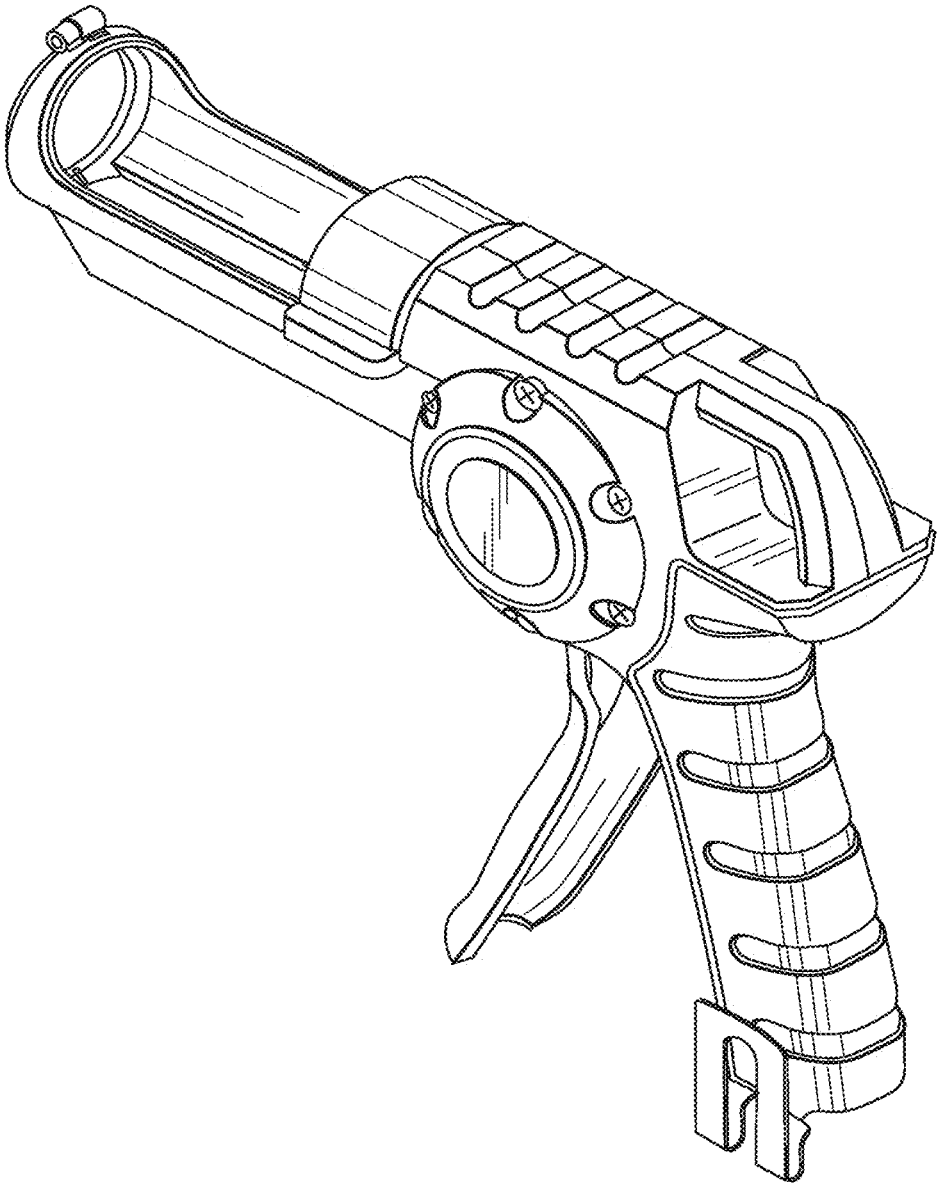

FIG. 4 illustrates an example tope portion of a tip or cartridge embodiment. FIG. 5A illustrates another example tip that may be used in some embodiments. The example tip in FIG. 5A is constructed in a duckbill configuration. FIG. 5B shows an alternative configuration having a domed slit valve and rib. FIGS. 5C-H illustrate other configurations for the tip, a flush trapper rubber sheet (FIG. 5C); a ribbed X valve (FIG. 5D); an inset trapped rubber sheet (FIG. 5E); inset x valve (FIG. 5F); wide duckbill valve (FIG. 5G); and domed slit valve (FIG. 5H).

Various embodiments were tested to ensure viability (e.g., provides flat even bead, seals effectively, and cleanable, among other options). FIGS. 6A-6D illustrate examples of an overmold cap and testing executed to ensure a flat even bead, cleaning, and sealing capability.

FIGS. 7A-7F illustrate views of an embodiment of a glue gun, and FIGS. 8A-8E illustrate additional views of another embodiment.

Having thus described several aspects of at least one example, it is to be appreciated that various alterations, modifications, and improvements will readily occur to those skilled in the art. For instance, examples disclosed herein can also be used in other contexts. Such alterations, modifications, and improvements are intended to be part of this disclosure, and are intended to be within the scope of the examples discussed herein. Accordingly, the foregoing description and drawings are by way of example only.

What is claimed:

1. A glue gun kit, comprising:

a glue gun comprising:

a molded housing comprising:

a handle;

a trigger;

a drive piston having a flexible portion disposed internal to the molded housing or the handle, the drive piston operable upon actuation of the trigger to advance a drive head at an end of the drive piston; and a cartridge housing constructed and arranged to accept and release adhesive cartridges; and an adhesive cartridge further comprising:

a body portion, comprising:

a cylindrical section having an interior to hold an adhesive; and a mating member disposed at a distal end of the cylindrical section for removably receiving any one of a plurality of differently-shaped dispensing tips; one of the plurality of differently-shaped dispensing tips removably attached to the body portion at the distal end; and a piston positionable at an opposite end of the body portion from the mating member, wherein the piston is constructed and arranged to travel the interior of the cylindrical section from the opposite end to the distal end, wherein, responsive to actuation of the piston, the adhesive is forced through the one of the differently-shaped dispensing tips removably attached to the mating member; and wherein the drive piston constructed and arranged to subtend an angle greater than 90 degrees and less than 180 degrees from end to end.

2. The glue gun kit of claim 1, wherein each of the plurality of differently-shaped dispensing tips comprises a self-sealing dispensing aperture biased to close in absence of an applied force.

3. The glue gun kit of claim 1, wherein the mating member comprises a threaded portion constructed and arranged to have the any one of the plurality of differently-shaped dispensing tips screwed thereon.

4. The glue gun kit of claim 3, wherein the body portion further comprises a connection section at the distal end of the cylindrical section, wherein the threaded portion of the mating member is disposed at least in part on the connection section.

5. The glue gun kit of claim 3, wherein the plurality of differently-shaped dispensing tips comprise dispensing apertures of different shapes.

6. The glue gun kit of claim 5, wherein first and second dispensing tips of the plurality of differently-shaped dispensing tips comprise a duckbill configuration and an inset x valve configuration, respectively.

7. The glue gun kit of claim 6, wherein each of the plurality of differently shaped dispensing tips further comprises a flexible sheet disposed proximate the aperture and including a slit.

8. The glue gun kit of claim 7, wherein the flexible sheet is biased to maintain the slit in a closed position.

9. The glue gun kit of claim 7, wherein the flexible sheet is biased to return the slit to a closed position.

10. The glue gun kit of claim 6, further comprising the plurality of differently-shaped dispensing tips.

11. The glue gun kit of claim 10, further comprising a plurality of differently-shaped caps constructed and arranged to fit the respective plurality of differently-shaped dispensing tips.

12. The glue gun kit of claim 1, wherein the drive piston is constructed and arranged to force an adhesive from any one of the plurality of differently-shaped dispensing tips.

13. The glue gun kit of claim 1, wherein the molded housing further comprises:

an actuated release mechanism constructed and arranged to permit retraction of the drive head of the drive piston responsive to actuation of the actuated release mechanism.

14. The glue gun kit of claim 13, wherein the actuated release mechanism is constructed and arranged to press, at least partially, into the molded housing of the glue gun upon the actuated release mechanism pressing towards the molded housing.

15. The glue gun kit of claim 13, wherein the actuated release mechanism comprises a button.

16. The glue gun kit of claim 13, further comprising a spring release constructed and arranged to engage the drive piston and exert a return force on the drive piston responsive to advancing the drive piston through an operating channel, and to disengage the drive piston in response to the actuation of the actuated release mechanism.

17. The glue gun kit of claim 13, wherein:

the drive piston is operable upon actuation of the trigger to advance the drive head in a first direction along the operating channel; and the actuated release mechanism is constructed and arranged to permit retraction of the drive head in a second direction opposite the first direction along the operating channel.

18. The glue gun kit of claim 17, further comprising a detent constructed and arranged to releasably engage the drive piston to hold the drive piston in position, wherein the actuated release mechanism disengages the detent from the drive piston responsive to the actuation of the actuated release mechanism.

19. The glue gun kit of claim 1, wherein the molded housing further comprises:

means for permitting retraction of the drive head of the drive piston responsive to actuation of the means.

* * * * *